US006239825B1

(12) United States Patent
Kuwabara et al.

(10) Patent No.: US 6,239,825 B1
(45) Date of Patent: May 29, 2001

(54) THERMAL PRINTING APPARATUS

(75) Inventors: Eiji Kuwabara, Saitama-ken; Hideo Saito; Kazuhiro Nomoto, both of Ibaraki-ken, all of (JP)

(73) Assignee: Nippon Typewriter Co., Ltd., Tokyo (JP)

( * ) Notice: Subject to any disclaimer, the term of this patent is extended or adjusted under 35 U.S.C. 154(b) by 0 days.

(21) Appl. No.: 09/255,342

(22) Filed: Feb. 23, 1999

(30) Foreign Application Priority Data

Mar. 2, 1998 (JP) ..... 10-066242

(51) Int. Cl.[7] ..... B41J 11/20
(52) U.S. Cl. ..... 347/197; 400/56
(58) Field of Search ..... 347/197, 198; 400/55, 56, 59

(56) References Cited

U.S. PATENT DOCUMENTS 4,990,003 * 2/1991 Jingu et al. ..... 400/56
5,066,152 11/1991 Kuzuya et al. ..... 400/621
5,149,210 * 9/1992 Eriksson ..... 400/56
5,458,423 10/1995 Sims et al. ..... 400/621
5,556,213 9/1996 Kudo et al. ..... 400/621

FOREIGN PATENT DOCUMENTS 5-20893 3/1993 (JP) .

* cited by examiner

*Primary Examiner*—N. Le
*Assistant Examiner*—Anh T. N. Vo
(74) *Attorney, Agent, or Firm*—Arent Fox Kintner Plotkin & Kahn, PLLC

(57) ABSTRACT

A thermal printing apparatus has a pair of transporting rollers for transporting a medium to be printed, a head angle member which holds a thermal head at right angles to a direction of transporting the medium transported by the pair of transporting rollers and which is pivotally supported at one end thereof, and a device for pivoting the head angle member so as to move the thermal head towards and away from the medium. The apparatus further has a shaft moving device which moves a shaft for mounting thereon the head angle member depending on a thickness of the medium.

9 Claims, 4 Drawing Sheets

THERMAL PRINTING APPARATUS

BACKGROUND OF THE INVENTION

1. Field of the Invention

The present invention relates to a thermal printing apparatus having a thermal head which is disposed at right angles to, and is arranged to be movable towards and away from, a medium which is to be printed while it is transported or fed in a predetermined feeding direction. It relates, in particular, to a thermal printing apparatus which is capable of printing on different thicknesses of media to be printed.

2. Description of the Related Art

There has conventionally been known a card printer, as a thermal printing apparatus, which has a thermal head movable towards and away from a medium to be printed while it is transported or fed in a predetermined feeding direction of the medium. In a thermal head of this thermal printing apparatus the heating elements are arranged at right angles to the direction of transporting the medium.

The card printer is a printing device for printing exclusively on a rigid card which is as thick as about 1 mm. On the other hand, the thermal printing apparatus is for printing characters, or the like, on different kinds of media such as plate-like media other than cards, or sheet-like media such as labelling sheets or the like. It is therefore necessary to print on media whose thicknesses vary, for example, from plates of about 3 mm thick to labelling sheets of about 0.1 mm thick.

FIG. 8 shows a printing region of a conventional thermal printing apparatus for printing on media of different thicknesses. A thermal head 50 of this thermal printing apparatus is disposed on a head angle member (or a thermal head holder) 53 at substantially the central portion thereof which is at a distance of 62 mm from a shaft 52 of the head angle member 53. This head angle member 53 is pivotally or swingably supported at one end thereof on the shaft 52. By the rotation of a cam 55 which comes into contact with the opposite end 54 of the head angle member 53 and the urging force of a spring 56, the thermal head 50 is moved in a direction towards, and away from, a medium P to be printed.

However, when the thickness of the medium P changes, the position of the thermal head 50 also changes, and the position of the thermal head 50 varies as shown in FIG. 8. If the thickness of the medium changes by 1 mm with this thermal printing apparatus, the head angle member 53 inclines about 0.9 degree. This inclination of the head angle member 53 leads to a change in the angle of contact of the thermal head with the medium to be printed. As a consequence, this conventional thermal printing apparatus has a disadvantage in that the printing quality becomes poor.

SUMMARY OF THE INVENTION

The present invention is a thermal printing apparatus having: a pair of transporting rollers for transporting a medium to be printed; a head angle member which holds a thermal head at right angles to a direction of transporting the medium transported by the pair of transporting rollers and which is pivotally supported at one end thereof; and head angle member pivoting means which pivots the head angle member so as to move the thermal head towards and away from the medium. The apparatus further comprises shaft moving means which moves a shaft for mounting thereon the head angle member depending on a thickness of the medium. Preferably, the pair of transporting rollers comprise a driving roller and a driven roller, and the shaft moving means moves the driven roller towards and away from the driving roller depending on a thickness of the medium. The thermal printing apparatus further comprises head pressure adjusting means which adjusts a head pressure of the thermal head based on an operation of the shaft moving means which is operated depending on the thickness of the medium.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

Figure 1:
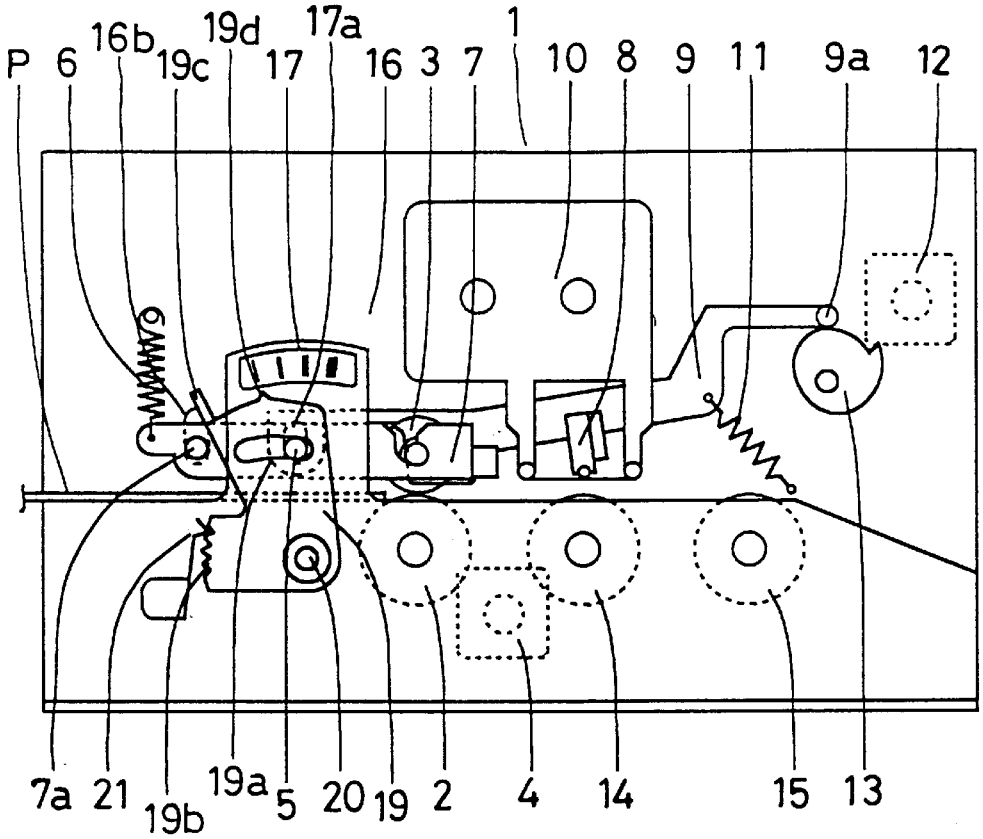
FIG. 1 is a front view of a thermal printing apparatus of the present invention in a state in which a thin medium to be printed is being transported or fed.
Figure 2:
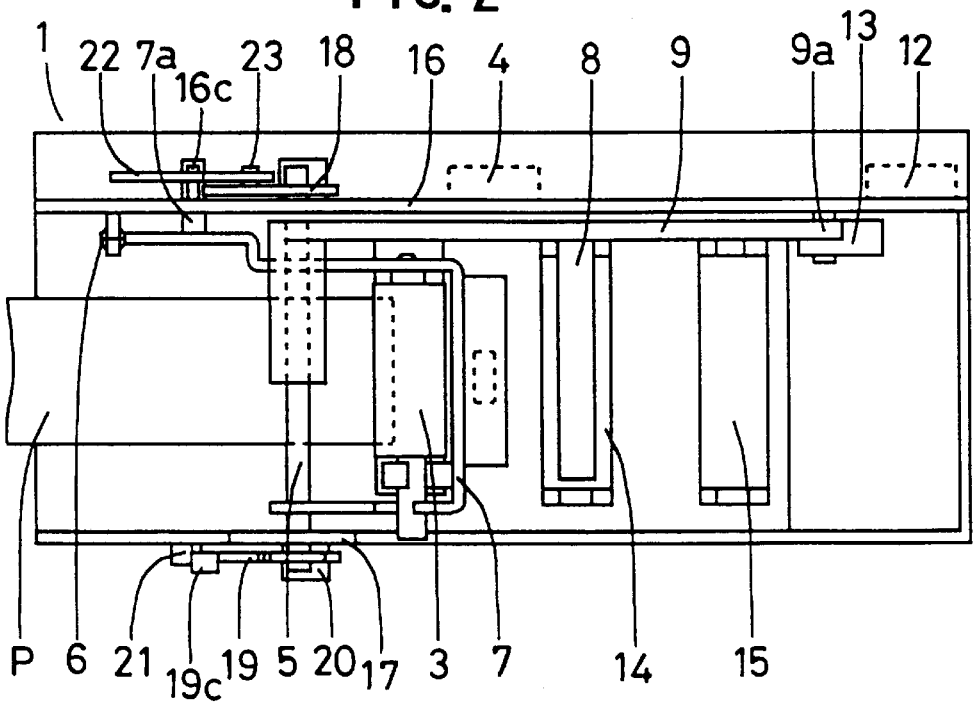
FIG. 2 is a plan view thereof with an ink ribbon cassette being omitted.

An explanation will now be made about a preferred embodiment of a thermal printing apparatus with reference to FIGS. 1 through 6.

The thermal printing apparatus 1 is to print characters or the like on a plate-like medium to be printed such as a hard acrylic plate or the like or on a sheet-like media (not illustrated) such as a soft vinyl chloride sheet based on printing data such as characters' data, format data or the like which are transferred from a personal computer (not illustrated) which is an external equipment serving as an inputting means for inputting the printing data.

A medium P which is to be printed is transported or fed from the left end, as seen in the figures, of the printing apparatus 1 towards a thermal head 8, which is described in detail hereinbelow, by means of a transporting roller 2 and a cleaning roller 3 which makes a mating pair with the transporting roller 2. The transporting roller 2 is rotated by the driving of a transporting motor 4 to transport the medium P to be printed. The cleaning roller 3 serves to remove the dirts or foreign matters off or away from the printing surface of the medium P. The cleaning roller 3 is rotatably supported on an end portion of a swing member 7 which is pivotally or swingably supported by a shaft 5 and which is urged by the tension of a spring 6 towards the transporting roller 2. Between this swing member 7 and the spring 6 there is formed a projecting pin 7*a* so as to pass through a vertically elongated slot 16*b* which is formed in a side plate 16 which is described hereinbelow in more detail.

The thermal head 8 is disposed in a direction in which the longitudinal direction of the row of heating elements is at right angles to the direction of transportation of the medium P. The thermal head 8 is disposed in approximately the central portion of a head angle member (or a head supporting member) 9 which is pivotally supported on the shaft 5, and at a distance of 62 mm away from the shaft 5. An ink ribbon cesset 10 is provided therein with an ink ribbon which is arranged to be reeled or wound up by the driving of the transporting motor 4.

An end portion 9*a* of the head angle member 9 is in contact with a cam 13 by the urging force of a head pressure spring 11. As a result of rotation of this cam 13 by the driving of a head urging or pushing motor 12, the head angle member 9 swings about the shaft 5. The thermal head 8 thus moves back and forth towards and away from a platen roller 14 which is described hereinbelow in more detail.

Like the above-described transporting roller 2, the platen roller 14 is disposed so as to rotate at the same speed with the transporting roller 2 by the driving of the transporting motor 4 via a conventional transmitting means such as gears or the like. The platen roller 14 is disposed so as to lie opposite to the thermal head 8. Like the above-described transporting roller 2, a transporting roller 15 is disposed so as to rotate by the driving of the transporting motor 4 via the conventional transmitting means such as gears or the like.

The shaft 5 on which is commonly and rotatably supported both the swing member 7 and the head angle member 9, is disposed so as to extend between same shape of slots 16*a*, 17*a* which are formed in a side plate 16 and in a side plate 17, respectively, in a manner to be vertically elongated, and horizontally positioned with each other. The shaft 5 is movable in the vertical direction along these slots 16*a*, 17*a*.

A plate thickness changeover cam 18 and a plate thickness changeover cam 19 are integrally disposed via a shaft 20 which is rotatably disposed to extend between the side plate 16 and the side plate 17. Each of the above-described cams 18, 19 is arranged to be swingable about the shaft 20 outside the respective side plates 16, 17. Each of the plate thickness changeover cam 18 and the plate thickness changeover cam 19 has a slot cam 18*a*, 19*a* of the same shape which is formed in parallel with each other so as to be away from the shaft 20 towards the left as seen in the figure. The above-described shaft 5 is inserted into these slots 18*a*, 19*a*.

The plate thickness changeover cam 19 has a ratchet-shaped positioning portion 19*b* which is formed by cutting away four portions to suit the thickness of the medium P to be printed. When an operator of the thermal printing apparatus swings the plate thickness changeover cam 19 by means of a handle portion 19*c* to suit the thickness of the medium P, the positioning portion 19*b* and an engaging projection 21 are engaged with each other to thereby fix the plate thickness changeover cam 19 to a desired position. An indicator 19*d* serves as a guide in adjusting the position of the plate thickness changeover cam 19 to a desired plate thickness.

In such a position of the plate thickness adjusting cam 18 as is most away from the shaft 20 thereof, there is rotatably provided a gap adjusting slide member 22 via a shaft 23. This gap adjusting slide member 22 has formed therein a notch 22*a* which is engaged with a projecting pin 16*c* on the side plate 16. It is thus so arranged that, when the plate thickness adjusting cam 18 is swung, the gap adjusting slide member 22 moves horizontally along the projecting pin 16*c*.

Figure 6:
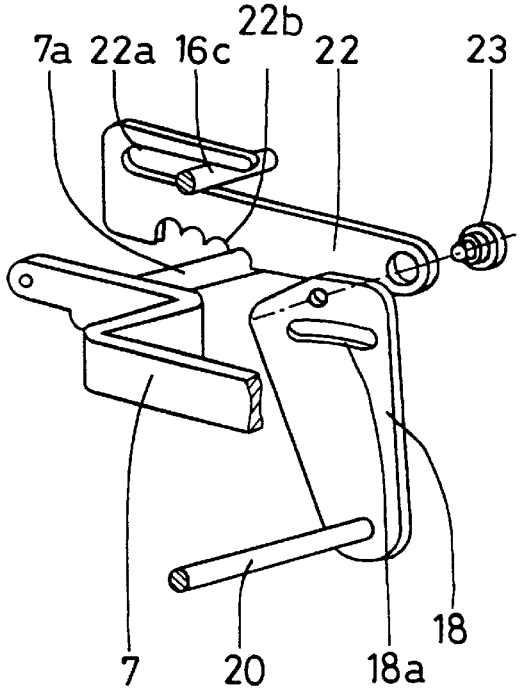
FIG. 6 is a partly enlarged view thereof.

This gap adjusting slide member 22 has a lack-shaped positioning portion 22*b* which is formed by cutting away four portions thereof so as to come into engagement with the projecting pin 7*a* of the swing member 7. The depth of the cut-away portions becomes larger towards the left as seen in FIG. 6. Therefore, when the gap adjusting slide member 22 slides, that projecting pin 7*a* of the swing member 7 which engages with the positioning portion 22*b* moves in the vertical direction along the slot 16*b* in the side plate 16.

Figure 3:
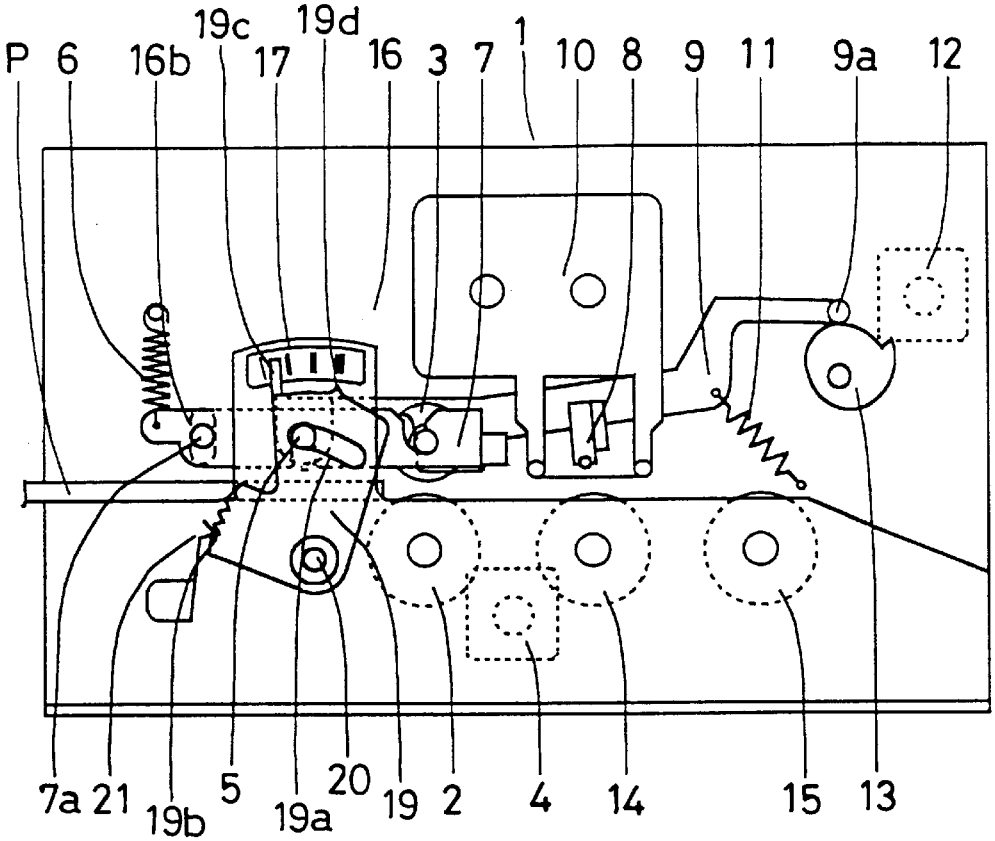
FIG. 3 is a front view of a thermal printing apparatus in a state in which a thick medium to be printed is being transported or fed.
Figure 4:
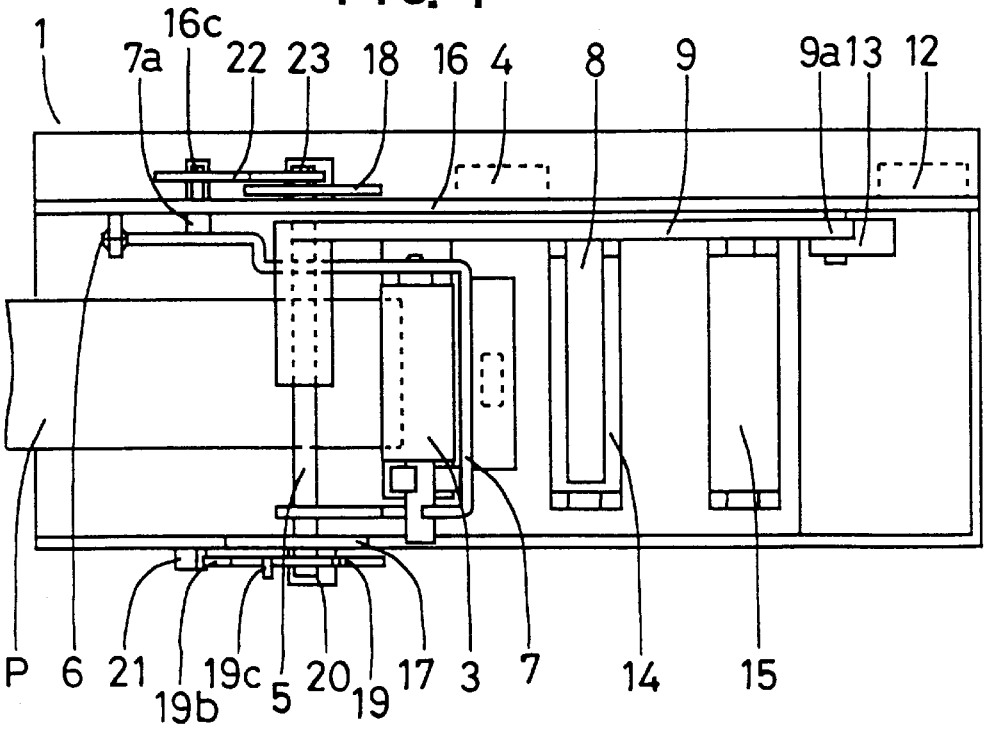
FIG. 4 is a plan view thereof with an ink ribbon cassette being omitted.
Figure 5:
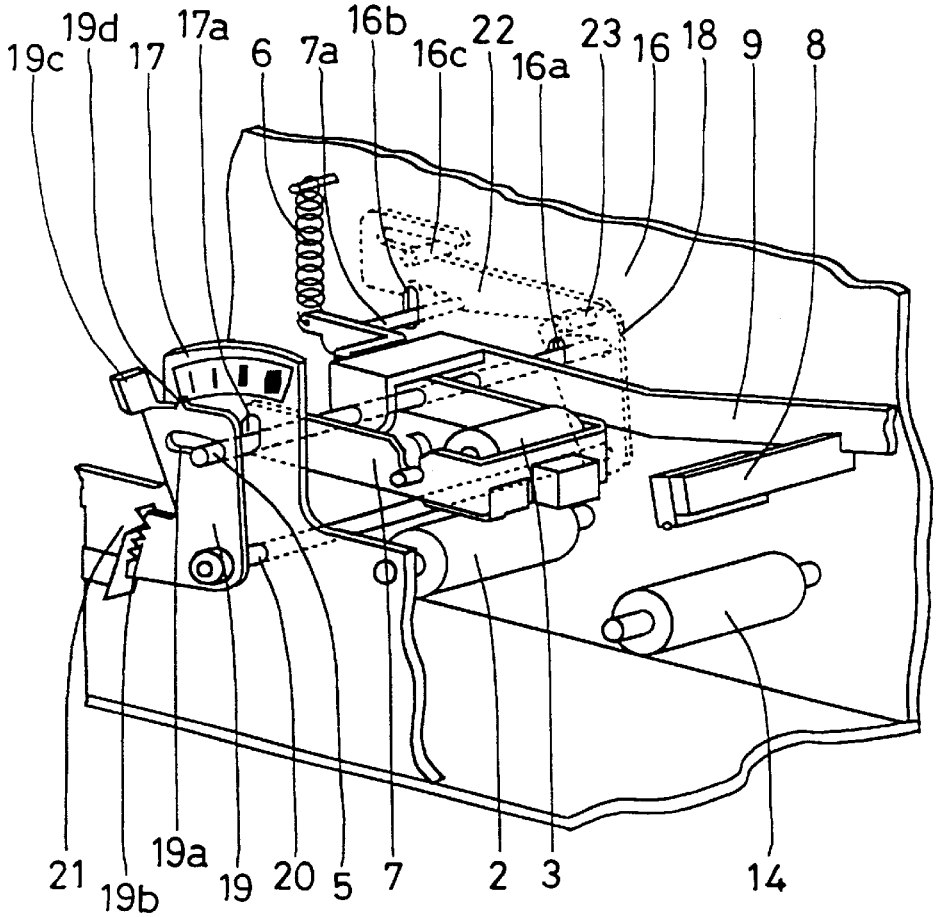
FIG. 5 is a perspective view of a shaft moving means for moving a shaft on which a head angle member is mounted.

An explanation will now be made about the operation in which the operator copes with or handles the medium P to be printed from the thinnest medium P of 0.5 mm thick as shown in FIG. 1 to the thickest one P of 3 mm thick as shown in FIG. 3. When the operator swings the plate thickness changeover cam 19 by means of the handle 19*c* thereof to the right as seen in the figures, the plate thickness changeover cam 18 also swings. The shaft 5 which is elongated to extend between the slots 16*a*, 17*a* moves upward along the slots 16*a*, 17*a* as a result of the movement of the slots 18*a*, 19*a*. The positioning portion 19*b* of the plate thickness changeover cam 19 then comes to a full stop as a result of its engagement with the projection 21. Consequently, the position of the shaft 5 is also fixed.

As a result of the swinging of the plate thickness changeover cam 18 to the right as seen in the figures, the gap adjusting slide member 22 also slides to the right with a slight resistance by the contact between the step in the positioning portion 22*b* and the projecting pin 7*a*. As a result of upward urging by the spring 6, the projecting pin 7*a* engages with the left endmost notch in the positioning portion 22*b*. By the upward movement of the projecting pin 7*a* of the swing member 7 and the shaft 5, the swing member 7 moves upward while maintaining the substantially horizontal posture even if the cleaning roller 3 gets out of contact with the transporting roller 2.

Once the printing work is thereafter started by the operator, the transporting roller 2, the platen roller 14 and the transporting roller 15 rotate first to thereby transport or feed the medium P to be printed. The cam 13 rotates in accordance with the timing of printing, and the head angle member 9 swings clockwise by the urging of the spring 11. The thermal head 8 thus comes into contact with the medium P of 3 mm thick. At this time, since the shaft 5 on which is mounted the head angle member 9 has been moved upward to cope with or to suit the thickness of the medium P, the thermal head 8 can contact the medium P at a normal or correct contact angle, whereby good printing can be performed.

Further, the swing member 7 which is swingably disposed on the shaft 5 together with the head angle member 9 has also been moved upward in a substantially horizontal posture, the distance between the transporting roller 2 and the cleaning roller 3 has been enlarged to suit the thickness of the medium P. Therefore, the transporting of the medium P can be made smoothly and the shock can be reduced at the time when the rear end of the medium P leaves the transporting roller 2 and the cleaning roller 3.

In the above-described embodiment of the present invention, it is so arranged that the number of positions of holding or fixing the plate thickness changeover cam can be switched in four stages. This number of four stages has been obtained from the difference in thicknesses of the media, dimensions in the thermal printing apparatus, and the actual printed conditions. The number of changeover positions is, however, not limited to the number of four, but may be increased or decreased depending on the conditions.

Figure 7:
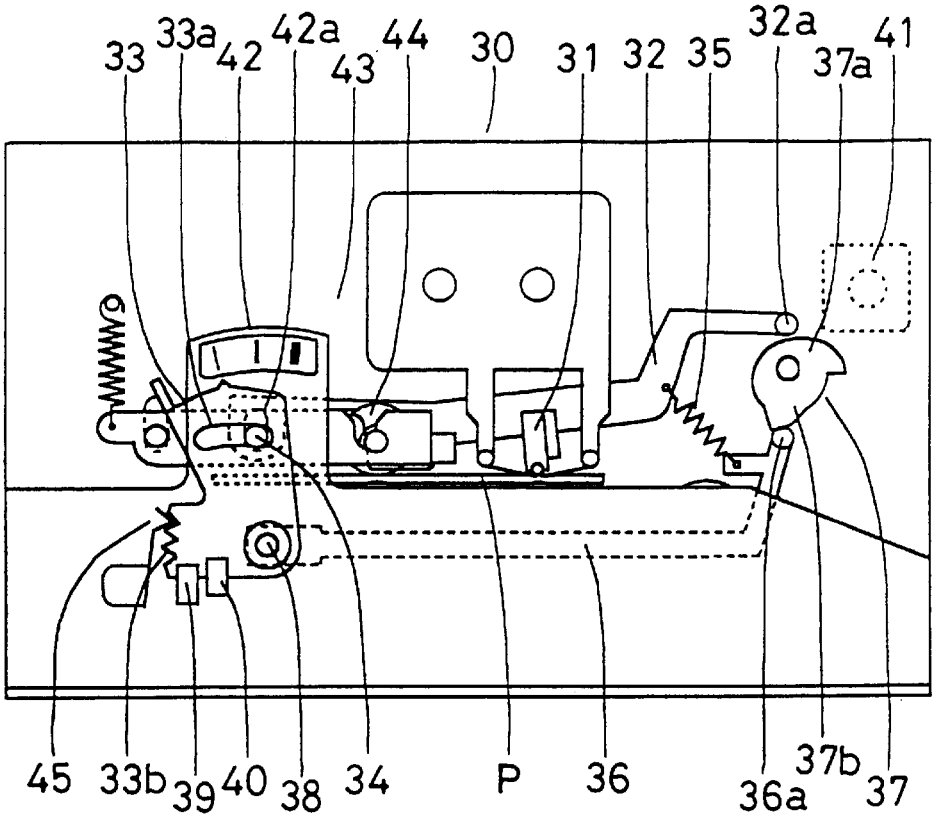
FIG. 7 is a front view of another embodiment of the thermal printing apparatus of the present invention.
Figure 8:
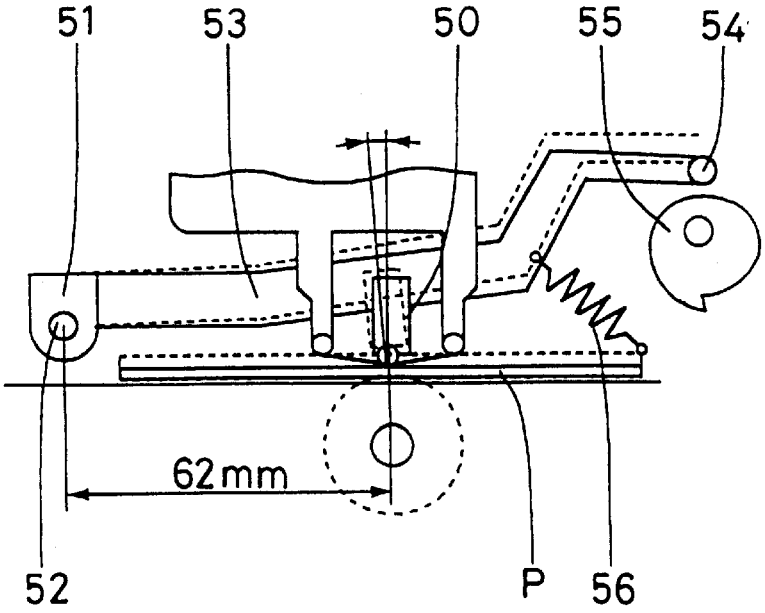
FIG. 8 PRIOR ART
FIG. 8 is an enlarged front view of a printing region of a conventional thermal printing apparatus.

FIG. 7 shows another embodiment of the thermal printing apparatus of the present invention. This thermal printing apparatus 30 is provided with a thermal head 31, a head angle member (or a thermal head holder) 32, and a plate thickness changeover cam 33 which are similar in construction to those of the above-described embodiment. A shaft 34 for mounting thereon the head angle member 32 is moved depending on the thickness of the medium to be printed. It is further provided with a head pressure arm 36 for adjusting the tension of a spring 35.

This thermal printing apparatus 30 is provided with a cam 37 which is made up by integrally forming a head angle region 37*a* which comes into contact with an end portion 32*a* of the head angle member 32, and a head pressure arm region 37*b* which comes into contact with an end portion 36*a* of the head pressure arm 36. By rotating this cam 37 it is possible to rotate the head angle member 32 about the shaft 34 and also to rotate the head pressure arm 36 about a shaft 38.

When the cam 37 rotates, the head angle member 32 swings first by the urging of the spring 35 which is provided to extend between the head angle member 32 and the head pressure arm 36. As a result of this swinging, the thermal head 31 moves towards the medium P to be printed. Once the thermal head 31 comes into contact with the medium P, the swinging of the head angle member 32 stops. When the cam 37 further rotates, the head angle region 37*a* and the end portion 32*a* of the head angle member 32 depart from each other, and a pressure is exerted on the thermal head 31 by the urging force of the spring 35.

In the head pressure arm region 37*b* during the rotation of the cam 37, the shape of the cam does not change. Thereafter, the cam 37 is rotated in accordance with the thickness of the medium P. FIG. 7 shows a state in which the printing is being made to the thinnest medium P. The position at which the thermal head 31 contacts the medium P is lower than the position at which the thermal head 31 contacts a thicker medium P. Therefore, the cam 37 is rotated to thereby swing the head pressure arm 36 clockwise as seen in the figure. According to this arrangement, the distance between the head angle member 32 and the head pressure arm 36 can be adjusted irrespective of the thickness of the medium P. It is thus possible to use the spring 35 of a predetermined extension length and to make the head pressure constant.

The rotation of this cam 37 is detected in the following manner. Namely, the position of the plate thickness changeover cam 33 whose plate thicknesses can be switched in three stages, is detected by the combination of ON and OFF of two sensors 39, 40. Based on the detected data on the plate thicknesses, the pulse number for the motor rotation control which is stored in advance in a ROM (not illustrated) is read out. The cam 37 is thus rotated by a motor 41 which is rotated by this pulse number.

The same construction as in the above-described thermal printing apparatus has been employed for the following, i.e., a side plate 42 (a slot 42*a*), a side plate 43, a cleaning roller 44, a projection 45, an elongated cam 33*a* and a positioning portion 33*b* of a plate thickness changeover cam 33.

In this embodiment, the position of holding or fixing the plate thickness changeover cam is arranged to be switchable in four or three stages. This number of stages has been obtained from the difference in thicknesses in the media to be printed, dimensions in each part of the printing apparatus, and the state of actual printing. However, the stages of switching are not limited to these figures but may be increased or decreased depending on the conditions.

According to the present invention, the position of the shaft for mounting thereon the head angle member which, in place, has mounted thereon the thermal head, can be moved depending on the thickness of the medium to be printed. As a result, the angle of contact of the thermal head with the medium to be printed can be maintained constant and good printing can therefore be performed.

It is readily apparent that the above-described thermal printing apparatus meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A thermal printing apparatus having:

a pair of transporting rollers for transporting a medium to be printed;

a head angle member that holds a thermal head at a right angle to a plane in which the medium transported by said pair of transporting rollers lies and that is pivotally supported at one end thereof; and a head angle member pivoting means that pivots said head angle member so as to move said thermal head toward and away from the medium;

wherein said apparatus further comprises shaft moving means for moving a shaft for mounting thereon said head angle member depending on a thickness of the medium.

2. A thermal printing apparatus according to claim 1, wherein said pair of transporting rollers comprise a driving roller and a driven roller, and wherein said shaft moving means moves said driven roller towards and away from said driving roller depending on the thickness of the medium.

3. A thermal printing apparatus according to claim 2, wherein the driven roller is a cleaning roller disposed opposite the transporting rollers and makes a mating pair with at least one transporting roller and serves to remove dirt and foreign matter away from a printing surface of the medium.

4. A thermal printing apparatus according to claim 1, further comprising head pressure adjusting means that adjusts a head pressure of said thermal head based on an operation of said shaft moving means that moves the shaft depending on the thickness of the medium.

5. A thermal printing apparatus according to claim 1, wherein said shaft moving means moves the shaft relative to the medium.

6. A thermal printing apparatus according to claim 5, wherein said shaft moving means moves the shaft toward and away from the medium.

7. A thermal printing apparatus according to claim 6, wherein said shaft moving means moves the shaft perpendicular relative to the medium.

8. A thermal printing apparatus according to claim 1, wherein the head angle member maintains the position of the thermal head at a non-zero angle relative to a plane in which the medium is transported when the thickness of the medium changes, by means of a shaft that is movable toward and away from the medium.

9. A thermal printing apparatus according to claim 8, wherein the thermal head angle member maintains the thermal head at a right angle to a plane in which the medium is transported when the thickness of the medium changes, by means of the shaft which is movable toward and away from the medium.

* * * * *